US011533980B2

(12) United States Patent
Kwong

(10) Patent No.: US 11,533,980 B2
(45) Date of Patent: Dec. 27, 2022

(54) DUAL LIP PRODUCT APPLICATOR HAVING A COSMETIC BULLET INSERT IN A HANDLE COMPONENT

(71) Applicant: Kristilynn Marie Kwong, Lindenhurst, NY (US)

(72) Inventor: Kristilynn Marie Kwong, Lindenhurst, NY (US)

( * ) Notice: Subject to any disclaimer, the term of this patent is extended or adjusted under 35 U.S.C. 154(b) by 864 days.

(21) Appl. No.: 16/392,639

(22) Filed: Apr. 24, 2019

(65) Prior Publication Data

US 2020/0337440 A1 Oct. 29, 2020

(51) Int. Cl.

| | |
|---|---|
| ***B05C 1/00*** | (2006.01) |
| ***A45D 40/06*** | (2006.01) |
| ***B65D 43/02*** | (2006.01) |
| ***A61Q 1/04*** | (2006.01) |
| ***A45D 40/24*** | (2006.01) |
| ***A45D 34/06*** | (2006.01) |
| *A45D 40/00* | (2006.01) |

(52) U.S. Cl.

CPC ..... *A45D 40/06* (2013.01); *A45D 34/06* (2013.01); *A45D 40/24* (2013.01); *A61Q 1/04* (2013.01); *B65D 43/02* (2013.01); *A45D 2040/0025* (2013.01)

(58) Field of Classification Search

CPC ..... A45D 34/06; A45D 40/24
USPC ..... 401/17
See application file for complete search history.

(56) References Cited

U.S. PATENT DOCUMENTS

| | | | | |
|---|---|---|---|---|
| 5,979,468 A * | 11/1999 | Blake, III | ..... | A45D 40/065 401/59 |
| 6,102,598 A * | 8/2000 | Hsu | ..... | A45D 40/065 401/59 |
| 8,662,775 B1 * | 3/2014 | Liu | ..... | A45D 40/262 401/23 |
| 2002/0083954 A1 * | 7/2002 | Gavney, Jr. | ..... | A45D 34/06 132/297 |

FOREIGN PATENT DOCUMENTS

| | | | | |
|---|---|---|---|---|
| WO | WO-0117390 A1 * | 3/2001 | ..... | A45D 34/06 |

* cited by examiner

*Primary Examiner* — Jennifer C Chiang
(74) *Attorney, Agent, or Firm* — Kimberly McLean, Esq; McLean Law LLC

(57) ABSTRACT

A dual lip product applicator having a cosmetic bullet insert. The device including a body member having a top region and a bottom region attachably connected to one another forming the body member. The top region includes a handle member having a cap at its proximate end for opening and closing a tip region of the handle member and having a lip applicator structure attached to its distal end. The cosmetic bullet insert is fixedly attached to an extraction mechanism for moving the cosmetic bullet insert up and down the internal cavity. The bottom region of the body member operates as a handle for the top region when applying the cosmetic bullet insert to a user's lips. The bottom region of the body member includes a container member for storing a lip product and for receiving a lip applicator structure for applying the lip product to the user's lips.

9 Claims, 1 Drawing Sheet

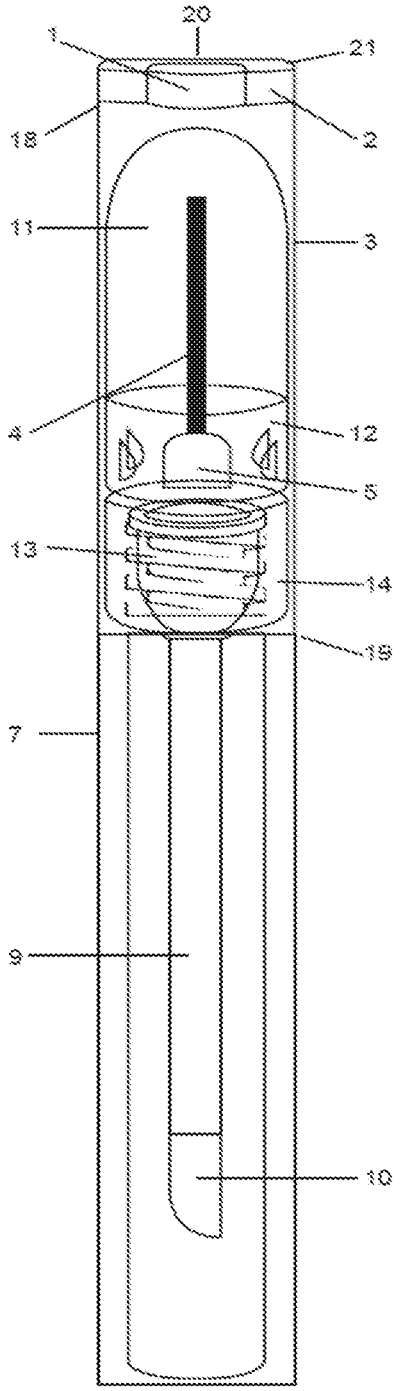
20
1
21
18
2
11
3
4
12
5
13
14
19
7
9
10

DUAL LIP PRODUCT APPLICATOR HAVING A COSMETIC BULLET INSERT IN A HANDLE COMPONENT

FIELD OF THE INVENTION

Embodiments described herein generally relate to lip applicators, and more particularly to a lip applicator including an insert for a cosmetic bullet.

BACKGROUND OF THE INVENTION

Oftentimes, it is desirable to apply a hydrating product to an individual's lips before applying another lip product, such as, for example, a cosmetic lip product. The hydrating product acts as a primer before applying the cosmetic lip product, which allows the cosmetic lip product to go on the lips smoothly and last longer without drying out the individual's lips. Presently, an individual has to carry two separate containers, one container for the hydrating lip product and a second container for the cosmetic lip product, in order to prime/hydrate the lips before applying a cosmetic product. Hence, it is desirable to provide an efficient way for an individual to have access to more than one lip product without having to carry each product separately.

BRIEF DESCRIPTION OF THE DRAWINGS

The various advantages of the embodiments of the present disclosure will become apparent to one skilled in the art by reading the following specification and appended claims, and by referencing the following drawing(s), in which:

FIG. 1 shows an exemplary view of a dual lip product applicator having a cosmetic bullet insert in a handle component according to an embodiment of the present disclosure.

SUMMARY OF THE INVENTION

Exemplary embodiments disclosed herein describe a dual lip product applicator device having a cosmetic bullet insert in a handle component. The device includes a body member having a top region and a bottom region which are attachably connected to one another, thereby forming the body member. The top region includes a handle member having a cap attached at its proximate end for opening and closing a tip region of the handle member and having an internal cavity for receiving a cosmetic bullet insert. The cosmetic bullet insert is fixedly attached to an extraction mechanism for moving the cosmetic bullet insert up and down the internal cavity. The extraction mechanism moves the cosmetic bullet insert upwards through the tip region of the handle member while the cap is in an open position so as to allow a user access to the cosmetic bullet insert. The bottom region of the body member operates as a handle when applying the cosmetic bullet insert to a user's lips. The bottom region of the body member includes a container member for storing a lip product and for receiving a lip applicator structure for applying the lip product to the user's lips. The lip applicator structure is fixedly attached to a distal end of the handle member in the top region. The handle member is used as a handle for applying the lip product in the bottom region to the user's lips when the bottom region is detached from the top region.

In some exemplary embodiments, the lip product in the bottom region is different from the cosmetic bullet insert in the top region.

In some exemplary embodiments, the extraction mechanism is a slider mechanism connected to a shaft, wherein cosmetic bullet insert is moved upwards when the slider mechanism and shaft are pushed in an upward direction.

In some exemplary embodiments, the extraction mechanism is a twist mechanism, wherein the cosmetic bulletin insert is moved upwards when the mechanism is turned in a twisting fashion.

In some exemplary embodiments, the lip applicator structure includes a stick shaft having a brush at its tip.

In some exemplary embodiments, the cosmetic bullet insert may include at least one product from the group comprising i) lip balm, ii.) lip scrub, iii) lipstick, iv) lip moisturizer, v) lip primer.

In some exemplary embodiments, the lip product may include a lip gloss.

In some exemplary embodiments, the cap includes a hinge for opening and closing the tip region of the handle member.

In some exemplary embodiments, the cap includes a twist element, which allows the cap to be twisted onto the handle member and twisted in a different direction to remove the cap from the handle member.

Another exemplary embodiment disclosed herein describes a dual lip product applicator including a body member having a top region and a bottom region which are attachably connected to one another thereby forming the body member. The top region having a handle member including a cap attached at its proximate end for opening and closing a tip region of the handle member, an internal cavity for storing a first lip product, and an extraction mechanism for extracting the first lip product from the handle member so as to allow a user access to the first lip product. The bottom region of the body member operates as a handle when applying the first lip product to a user's lips. The bottom region of the body member including a container member for storing a second lip product and for receiving a lip applicator structure for applying the second lip product to the user's lips. The handle member in the top region is used as a handle for applying the second lip product in the bottom region to the user's lips when the bottom region is detached from the top region.

In some exemplary embodiments, the first lip product may include a cosmetic bullet insert.

In some exemplary embodiments, the first and second lip products are different from one another.

In some exemplary embodiments, the cosmetic bullet insert includes at least one product from the group comprising i) lip balm, ii.) lip scrub, iii) lipstick, iv) lip moisturizer, v) lip primer, vi) lip gloss.

DETAILED DESCRIPTION

The present disclosure relates to a dual lip product applicator device ("the device"). The device provides an efficient way of integrating two lip products in one housing unit. The device integrates a cosmetic bullet insert into the handle member for a lip product stored in a container region of the device. The lip products may include any type of lip products, such as, for example, lip gloss, lipstick, lip balm, lip scrub, lip primer, lip moisturizer, etc. As illustrated in FIG. 1, the device includes a body member 20. The body member includes a top region 18 and a bottom region 19, which both collectively form the body member when both regions are attachably connected. The body may be constructed of any suitable materials, such as, for example, plastic, metal or glass.

The top region 18 includes a handle member 3 having a cap 1 attached at its proximate end for opening and closing a tip region 21 of the handle member. The cap seals the contents contained in the handle member. The cap includes a hinge 2 for attaching the cap to the handle member and for allowing the cap to open and close relative to the handle member. In another embodiment, the cap includes a twist element which allows the cap to be twisted onto the handle member for attachment and twisted in an opposite direction for removing the cap from the handle member.

The handle member 3 includes an internal cavity for receiving a cosmetic bullet insert 11. The cosmetic bullet insert is a cosmetic product constructed in a bullet form for insertion into a tube/cavity. The cosmetic product may be any cosmetic product. In a preferred embodiment, the cosmetic product is a lip product, such as, for example, lip balm, lipstick, lip scrub, lip primer, lip moisturizer, lip gloss, or any other product that may be applied to a user's lips.

The handle member 3 is a housing component for the top region which stores all the internal components within the top region. Other internal components included in the handle member include a body funnel 12, a stick holder 13, and a stick shaft 14. The stick holder holds the body funnel and assists with properly sealing the cap 1 and the container 7 together. The stick shaft connects to the stick holder.

The cosmetic bullet insert 11 is fixedly attached to an extraction mechanism (refer to References 4 and 5). The extraction mechanism moves the cosmetic bullet insert up and down the internal cavity within the handle member. The extraction mechanism moves the cosmetic bullet insert upwards through the tip region 21 of the handle member 3 while the cap is in an open position so as to allow a user access to the cosmetic bullet insert. The bottom region of the body member operates as a handle when applying the cosmetic bullet insert to a user's lips. The extraction mechanism moves the cosmetic bulletin insert downward re-insert the bullet into the internal cavity.

The extraction mechanism (4, 5) may be any suitable structure which is capable of moving the cosmetic bullet insert 11 up and down in the internal cavity of the handle member 3. The extraction mechanism may include a slider mechanism 4 connected to a shaft 5. In this configuration, the cosmetic bullet insert 11 is pushed upwards when the slider mechanism and attached shaft are pushed in an upward direction. In another embodiment, the extraction mechanism may include a twist mechanism wherein the cosmetic bullet insert 11 is pushed in an upwards direction in response to the twist mechanism being turned in a twisting fashion.

The bottom region 19 of the body member 20 includes a container 7 for storing a lip product and for receiving a lip applicator structure 9 for applying the lip product to a user's lip. The lip applicator structure is fixedly attached to a distal end of the handle member 3 in the top region 18. The handle member 3 is used as a handle for applying the lip product in the bottom region 19 to the user's lips when the bottom region is detached from the top region 18.

The lip applicator structure 9 may be any suitable structure which allows a user to apply a lip product. The lip applicator structure may include a stick shaft 9 having a brush 10 at its tip. The lip product may include any suitable product that may be applied to a user's lips, such as, for example, lip balm, lipstick, lip scrub, lip primer, lip moisturizer, lip gloss, or any other product that may be applied to a user's lips. In a preferred embodiment, the lip product is a lip gloss. The lip product in the bottom region 19 may be different from the cosmetic bullet insert 11 in the top region 18.

In another exemplary embodiment, the top region 18 of the body member 20 includes a first lip product and the bottom region 19 of the body member 20 a includes a second lip product, wherein the first and second lip products are different.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.)

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

Those skilled in the art will appreciate from the foregoing description that the broad techniques of the embodiments of the present invention may be implemented in a variety of forms. Therefore, while the embodiments of this invention have been described in connection with particular examples thereof, the true scope of the embodiments of the invention should not be so limited since other modifications will become apparent to the skilled practitioner upon a study of the drawings, specification, and following claims.

What is claimed is:

1. A dual lip product applicator device comprising:

a body member having a top region and a bottom region which are attachably connected to one another thereby forming the body member, the top region including a cap and a handle member, the cap including an attachment mechanism for attaching the cap directly to a proximate end of the handle member for opening and closing a tip region of the handle member, the handle member including an internal cavity which encloses a stick holder, an extraction mechanism and a cosmetic bullet insert, the cosmetic bullet insert is fixedly attached to an extraction mechanism for moving the cosmetic bullet insert up and down the internal cavity, the extraction mechanism moves the cosmetic bullet insert upwards through the tip region of the handle member while the cap is in an open position so as to allow a user access to the cosmetic bullet insert, the bottom region of the body member operates as a handle when applying the cosmetic bullet insert to a user's lips, the bottom region of the body member including a container member for storing a lip product and for receiving a lip applicator structure for applying the lip product to the user's lips, the lip applicator structure is fixedly attached directly to a distal end of the handle member in the top region, and the handle member is used as a handle for applying the lip product in the bottom region to the user's lips when the bottom region is detached from the top region;

wherein the handle member included in the top region is a housing component for the top region which stores all the internal components within the top region; and wherein the stick holder seals the cap and the container member together.

2. The device of claim 1, wherein the lip product in the bottom region is different from the cosmetic bullet insert in the top region.

3. The device of claim 1, wherein the extraction mechanism is a slider mechanism connected to a shaft, wherein cosmetic bullet insert is moved upwards when the slider mechanism and shaft are pushed in an upward direction.

4. The device of claim 1, wherein the extraction mechanism is a twist mechanism, wherein the cosmetic bulletin insert is moved upwards when the mechanism is turned in a twisting fashion.

5. The device of claim 1, wherein the lip applicator structure includes a stick shaft having a brush at its tip.

6. The device of claim 1, wherein the cosmetic bullet insert may include at least one product from the group comprising i) lip balm, ii.) lip scrub, iii) lipstick, iv) lip moisturizer, v) lip primer.

7. The device of claim 1, wherein the lip product may include a lip gloss.

8. The device of claim 1, wherein the attachment mechanism is a hinge for opening and closing the tip region of the handle member.

9. The device of claim 1, wherein the attachment mechanism is a twist element, which allows the cap to be twisted onto the handle member and twisted in a different direction to remove the cap from the handle member.

* * * * *